US007578893B2

(12) United States Patent
Weber et al.

(10) Patent No.: US 7,578,893 B2
(45) Date of Patent: Aug. 25, 2009

(54) ELECTRICAL CONTACT MATERIAL COMPRISING A COBALT-NICKEL-IRON ALLOY

(75) Inventors: Hartwin Weber, Hanau (DE); Waldemar Döring, Hasselroth (DE); Matthias Schierling, Babenhausen (DE)

(73) Assignee: Vacuumschmelze GmbH & Co. KG, Hanau (DE)

( * ) Notice: Subject to any disclaimer, the term of this patent is extended or adjusted under 35 U.S.C. 154(b) by 354 days.

(21) Appl. No.: 11/206,885

(22) Filed: Aug. 18, 2005

(65) Prior Publication Data

US 2006/0045788 A1 Mar. 2, 2006

Related U.S. Application Data

(63) Continuation of application No. PCT/DE2004/000309, filed on Feb. 19, 2004.

(51) Int. Cl.
*C22C 19/07* (2006.01)
*C22C 38/10* (2006.01)
*C22C 38/08* (2006.01)

(52) U.S. Cl. ..... 148/336; 148/408; 148/419; 148/425; 420/95; 420/440; 420/581; 439/887

(58) Field of Classification Search ..... 148/442, 148/425, 336, 419, 408, 313; 420/440, 95, 420/581; 75/246; 439/887
See application file for complete search history.

(56) References Cited

U.S. PATENT DOCUMENTS

| | | | | |
|---|---|---|---|---|
| 5,026,435 A | 6/1991 | Nakamura et al. | ..... | 148/12 A |
| 5,147,470 A | 9/1992 | Nakamura et al. | ..... | 148/677 |
| 5,246,511 A | 9/1993 | Nakamura et al. | ..... | 148/621 |
| 6,221,183 B1 | 4/2001 | Sato et al. | ..... | 148/505 |
| 6,776,855 B1 * | 8/2004 | Ueda et al. | ..... | 148/328 |

FOREIGN PATENT DOCUMENTS

| | | | |
|---|---|---|---|
| GB | 1406096 | | 9/1975 |
| JP | 56-5950 | * | 1/1981 |
| JP | 58-83124 | * | 5/1983 |

OTHER PUBLICATIONS

International Search Report; PCT/DE2004/000309; 4 pp., Aug. 31, 2004.

International Preliminary Examination Report; PCT/DE2004/000309; 6 pp., Jan. 17, 2005.

Keil, Albert, et al.; Werkstoffe für elektrische Kontakte; Springer-Verlag; 3 pp., 1960.

Tanaka, Minoru, et al.; On the Isothermal Age-Hardening of Fe-Ni-Co Marensitic Alloys; Bulletin of the Tokyo Institute of Technology, No. 112; pp. 49-60.

Burger, E.E.; Fernico From Metal Powders; General Electric Review, pp. 22-24, Dec. 1946.

Magee, C.L., et al.; On the Volume Expansion Accompanying the F.C.C. to B.C.C. Transformation in Ferrous Alloys; ACTA Metallurgica, vol. 20, pp. 1031-1043, Aug. 1972.

* cited by examiner

*Primary Examiner*—Deborah Yee
(74) *Attorney, Agent, or Firm*—King & Spalding L.L.P.

(57) ABSTRACT

A material for electrical contacts comprising a martensitic cobalt-nickel-iron alloy with a high strength, a high bendability and a high electrical conductivity, with a cobalt content of 12.0≦Co≦60.0% by weight, a nickel content of 10.0≦Ni≦36.0% by weight, remainder iron and an impurity content of less than 0.2 atomic percent, with a martensite temperature Ms of 75° C.≦Ms≦400° C. in the case of the martensitic variant and −50° C.≦Ms≦25° C. in the case of the variant which is naturally hard as a result of cold-forming.

9 Claims, 9 Drawing Sheets

FIG 11

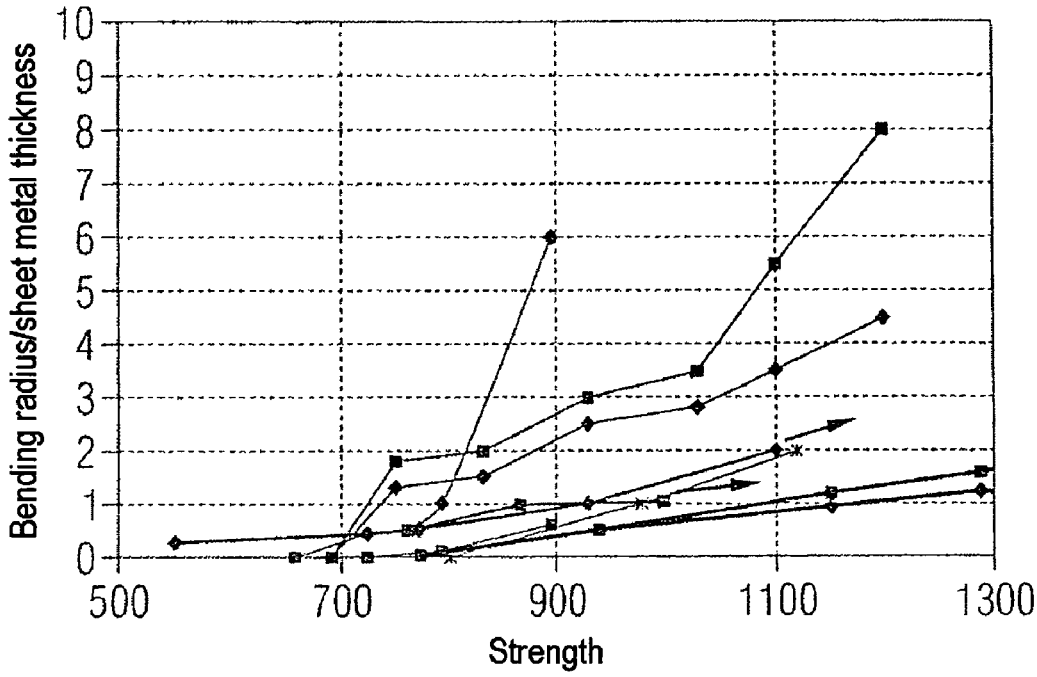

Pfinodal longitudinally to WR, WV

Conductive strong naturally hard melt C+D longitudinally/ transversely to WR

CuBe 2 WV Soner longitudinally/ transversely

Pfinodal transversely to WR, WV

Conductive strength naturally hard melt F longitudinally/ transversely to WR

CuBe 2 WV longitudinally to WR

NiBe 2 longitudinally to WR

CuBe 2 WV transversely to WR

NiBe 2 transversely to WR

ELECTRICAL CONTACT MATERIAL COMPRISING A COBALT-NICKEL-IRON ALLOY

CROSS-REFERENCE TO RELATED APPLICATIONS

This application is a continuation of co-pending International Application No. PCT/DE2004/000309 filed Feb. 19, 2004, which designates the United States of America, and claims priority to German application number DE 103 07 314.0 filed Feb. 20, 2003, the contents of which are hereby incorporated by reference in their entirety.

TECHNICAL FIELD

The invention relates to electrical contact materials, in particular contact spring materials.

BACKGROUND

Electrical contact materials are supposed to transmit electric currents as far as possible without losses and safely. This current conduction takes place through interfaces for which a metallic conduction mechanism cannot be assumed in all cases. Specifically, there are then possibilities for charge transfer both by virtue of semiconductor effects in non-metallic covering layers and by virtue of any gas discharge mechanisms in the open contact gap. From a pure design perspective, the following demands may be imposed on such conductive connections between different components:

1. The connection should be permanent, and can accordingly be made by purely mechanical means, such as screw or clamp connections or spring elements, or by metallurgical measures, such as welding or soldering.

2. The connection should only be made at discrete time intervals. The components are then described as interrupter or breaker contacts. Among these contacts, a distinction needs to be drawn between the groups of contacts which switch without current and the group of contacts in which there is a flow of current during the switching operation.

3. The connection is to be made between components which are used to transmit a flow of current while they are moving relative to one another. The components are then referred to as rubbing or sliding contacts.

Currently, it is primarily copper-based alloys comprising two or more substances which are used for these applications. What are known as beryllium bronzes, i.e. technical-grade copper alloys containing, for example, 1.2, 1.7 and 2.0% by weight of beryllium, are in widespread use. These alloys have very good hot age-hardening properties and in terms of their ratio of strength to deformability and to conductivity are among the highest quality copper-based electrical contact materials currently available. In addition to the abovementioned binary beryllium bronzes, ternary beryllium bronzes with beryllium contents of less than 1% by weight and additions of up to 3% by weight of nickel or cobalt are also commercially available. A large proportion of these materials are used in the as-produced heat-treated state, i.e. the heat treatment is carried out by the manufacturer of the alloy.

On account of the increasingly strict regulations on electrical scrap throughout the world, electrical scraps have to be disposed of as special waste. Consequently, beryllium bronzes will become much more expensive in the near future, since the toxic effect of beryllium means that their disposal costs are relatively high.

SUMMARY

Therefore, it is an object of the present invention to find a replacement material for electrical contacts which has a very high strength, good deformability, in particular bendability, a high electrical conductivity and/or a high thermal conductivity and which can be scrapped without problems. This material should be able to replace the conventional beryllium bronzes described in the introduction, in particular the binary beryllium bronzes.

According to the invention, this object is achieved by a material for electrical contacts comprising a martensitic cobalt-nickel-iron alloy with a high strength, a high bendability and a high electrical conductivity, which consists essentially of a cobalt content of $12.0 \leqq Co\ 60.0\%$ by weight, a nickel content of $10.0 \leqq Ni \leqq 36.0\%$ by weight, remainder iron and an impurity content of less than 0.2 atomic percent, and has a martensite starting temperature Ms of $75° C. \leqq Ms \leqq 400° C.$ or a martensite starting temperature Ms of $-50° C. \leqq Ms \leqq 25° C.$ The choice of alloy with a martensite starting temperature Ms of $75° C. \leqq Ms \leqq 400° C.$ represents what is known as an age-hardenable alloy which, in a similar way to maraging steels, are produced by establishing a fully martensitic microstructure, which has a significantly better conductivity than austenite, and by age-hardening via the formation of ordering and first traces of the microstructure breaking down into the stable austenite and ferrite. The electrical conductivity is improved significantly by the ordering transition and the recovery which takes place in parallel. In this case, however, unlike with maraging steels, there is no need for an age-hardening addition. The use of an age-hardening addition as in the case of beryllium bronzes would in fact greatly reduce the electrical conductivity.

The second choice of alloy, with a martensite starting temperature of Ms of $-50° C. \leqq Ms \leqq 25° C.$ represents what is known as a naturally hard alloy system, in which the martensite is formed from the unstable austenite by cold-forming. This leads to extensive work-hardening and high strengths in this state, which can compete with those of as-produced heat-treated beryllium bronzes.

A common factor for both choices of alloy is that the conductivity increases toward higher cobalt contents. Accordingly, for both choices of alloy variants with a relatively high cobalt content, typically a cobalt content of $45.0 \leqq Co \leqq 60.0\%$ by weight is preferred. On the other hand, for cost reasons it is aimed to use low Co contents.

If the naturally hard alloy is selected, the nickel content is typically set on the basis of the cobalt content, which determines the conductivity, by means of the following formula:

$$Ni = -0.3696 * Co + 34.65\% \text{ by weight.}$$

On the other hand, if the age-hardenable alloy is selected, the nickel content is based on the cobalt content, which determines the conductivity, typically by means of the following formula:

$$Ni = -0.3414 * Co + 32.429\% \text{ by weight.}$$

The above two rules for setting the nickel content makes it possible to accurately reach the martensite starting temperatures (Ms) referred to above.

The impurities in the alloys should be minimized. Impurities of less than 0.05 atomic percent have proven particularly suitable for achieving particularly good electrical conductivities. Doubling these impurities to 0.1 atomic percent results in an electrical conductivity which is approximately 5% lower, and quadrupling the impurities to 0.2 atomic percent results in an electrical conductivity which is approximately 17 percent lower.

The melt-metallurgy process according to the invention for producing a cobalt-nickel-iron alloy with a high strength, a high bendability and a high electrical and/or thermal conductivity comprises the following steps:

a) melting and casting of starting materials to form an ingot consisting essentially of 12.0 to 60.0% by weight of cobalt, 10.0 to 36.0% by weight of nickel, remainder iron and impurities of less than 0.2 or 0.1 or 0.05 atomic percent;
b) hot-rolling of the ingot at a temperature in the range between 1300° C. and 900° C. to form a strip, a rod or a wire;
c) quenching of the hot-rolled strip/wire/rod to a temperature of approx. 200-500° C.;
d) (first) cold-forming of the strip or drawing of the wire or rod;
e) continuous annealing at a temperature of between 900 and 950° C.

If the "naturally hard" alloy is selected, this must also be followed by the step of:

f) cold-forming by more than 70%.

This is possible but not necessary in the case of "age-hardenable" martensitic variants.

To ensure particularly good electrical conductivities, deoxidising agents and/or desulphurizing agents, such as cerium mischmetal or manganese, silicon, calcium or magnesium or the like are added during the melting operation. The melting process is controlled in such a way that these additions are as far as possible completely consumed, settle in the slag and after casting are present in the ingot, together with other dissolved impurities, in an amount of less than 0.2 or 0.1 or 0.05 atomic %.

The powder-metallurgy process according to the invention for producing a cobalt-nickel-iron alloy with a high strength and a high electrical conductivity comprises the following steps:

a) mixing, compacting and stage sintering of pulverulent starting materials to form a billet or slab consisting essentially of 12.0 to 60.0% by weight of cobalt, 10.0 to 36.0% by weight of nickel, remainder iron and an impurity content of less than 0.2 or 0.1 or 0.05 atomic percent;
b) hot-rolling of the billet or slab at a temperature in the range between 1300° C. and 900° C. to form a strip, a rod or a wire;
c) quenching of the hot-rolled strip, the rod or the wire to a temperature of approx. 200-500° C.;
d) (first) cold-forming of the strip, rod or wire;
e) continuous annealing at a temperature of between 900° C. and 950° C.

If the "naturally hard" alloy is selected, this must then be followed by the step of:

f) cold-forming by more than 70%.

This is possible but not necessary in the case of the age-hardenable martensitic variants.

In both the melt-metallurgy production process and the powder-metallurgy production process, the continuous annealing may be followed by at least one further cold-forming operation and a final anneal of the cold-formed strip at a temperature of approx. 900° C. and 950° C., i.e. steps d) and e) can be repeated.

In this way, the present invention realizes high-conductivity and high-strength cobalt-nickel-iron alloys with excellent mechanical and physical properties which are able to replace the binary copper beryllium bronzes with beryllium contents of, for example, 1.2; 1.7 or 2.0% by weight.

On account of their excellent electrical conductivity and the associated excellent thermal conductivities as well as their mechanical properties, the alloys according to the invention can be used as materials for permanent electrical contacts, for electrical interrupter and breaker contacts and for electrical rubbing and sliding contacts.

On account of their high hardness, they can be used in particular as test tips for integrated circuits in semiconductor technology, cable harnesses, circuit boards. In this case, they not only form an alternative to the binary copper beryllium bronzes cited, but also to tungsten and tungsten alloys. Furthermore, in particular on account of their good spring and wear properties, they can be used as brushes made from wire for resistance transducers with sliding contacts, inter alia as an alternative to palladium alloys. On account of their low work-hardening and the small number of intermediate anneals during production, the age-hardenable alloy option is particularly suitable for the production of wire in this context.

On account of the excellent thermal conductivity, there are also possible uses outside electrical engineering, in mechanical engineering wherever heat is to be transferred under simultaneous static or dynamic loads, in particular for plastic injection molds, for light metal casting tools and light metal casting rams or dies.

Further features and advantages of the invention are explained in connection with the following description of preferred exemplary embodiments. These will be readily apparent from the following description. It will be clearly understood that the description of the invention given above and below is only by way of example to provide a further explanation of the claimed invention.

BRIEF DESCRIPTION OF THE DRAWINGS

The appended drawings, which are intended to assist with gaining an understanding of the invention and are appended as part of the present invention, illustrate exemplary embodiments of the invention and serve to provide a better understanding of the basic concept of the invention in conjunction with the description. In the drawing:

FIG. 11 shows the comparison of the bending radii with respect to strength between various naturally hard alloys from the present invention by comparison with naturally hard or in-factory heat-treated alloys from the prior art;

DETAILED DESCRIPTION

Figure 1:
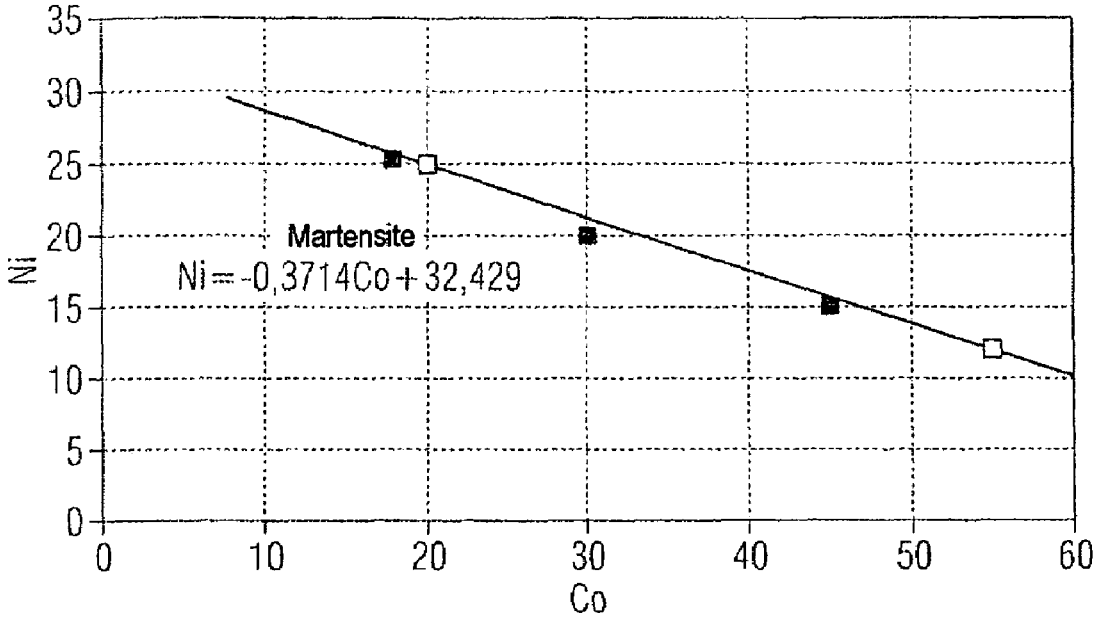
FIG. 1 shows the nickel-cobalt composition for achieving the age-hardenable cobalt-nickel-iron alloy.
Figure 2:
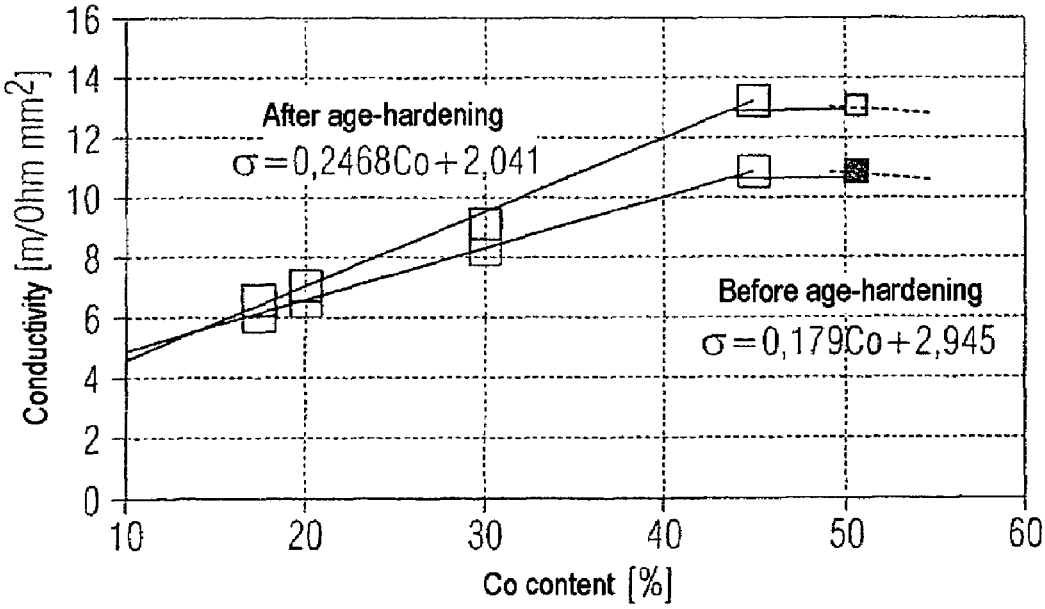
FIG. 2 shows the electrical conductivity of the age-hardenable cobalt-nickel-iron alloy as a function of the cobalt content.

The corrosion properties of the Co—Ni—Fe alloys according to the invention are very good under room conditions but sensitive to the presence of salts. In the case of coatings formed by electroplating, the absence of passivation layers means that activation steps can be reduced or omitted altogether. In particular when producing gold contacts, there is no need for nickel diffusion barriers. This is a clear advantage of the alloys according to the invention over the binary copper beryllium bronzes and other copper alloys.

Joining techniques such as soldering, welding are comparable to those for nickel-iron alloys. In the case of soldering, in particular there is no need for strong fluxes or preliminary coatings with Ni or Sn, as in the case of the copper beryllium bronzes.

The preferred exemplary embodiments of the present invention, which are illustrated by way of example in the appended drawings, will now be dealt with in detail.

The age-hardenable alloy option will be discussed first. It can be produced by setting a fully martensitic microstructure, which has a significantly better conductivity than austenite. The age-hardening takes place via the formation of ordering and first traces of transformation back into austenite. This procedure is known from the technology of maraging steels. The conductivity is drastically improved by ordering and the recovery which takes place in parallel. A positive effect in this context is that there is no need for an age-hardening addition, which reduces the conductivity unnecessarily. The age-hardening therefore does not take place by precipitation hardening. Furthermore, a very high purity should be ensured.

The martensite starting temperature (Ms) is an important parameter of these alloys for fixing the optimum alloy composition. It should be sufficiently above room temperature to achieve complete transformation at room temperature. However, it should also not be significantly above 400° C., such that no further age-hardening takes place if the cooling is not especially rapid when using large cross sections.

The result of this is that the nickel content has to be matched to the respective cobalt content. The properties of various test melts for age-hardenable alloys are compiled in Table 1.

TABLE 1

| | Composition (% by weight) remainder Fe | | | | | Without age-hardening | | After 1 h at 400° C. | | |
|---|---|---|---|---|---|---|---|---|---|---|
| Batch | Co | Ni | Mn | Si | Cold-forming (%) | Hardness (HV) | Electrical conductivity (m/Ω mm$^2$) | Hardness (HV) | Electrical conductivity (m/Ω mm$^2$) | Part of the invention |
| Melt A | 45 | 15 | | | 0 | 314 | 10.97 | 460 | 13.41 | Yes |
| | | | | | 40 | 370 | | 522 | | |
| | | | | | 70 | 376 | 10.82 | 542 | 12.39 | |
| | | | | | 80 | | 10.12 | | 12.06 | |
| Melt B | 30 | 20 | | | 0 | 318 | 8.53 | 455 | 9.12 | Yes |
| | | | | | 40 | 360 | | 515 | | |
| | | | | | 70 | 370 | 8.48 | 530 | 9.05 | |
| | | | | | 80 | | 8.26 | | 8.79 | |
| Melt C | 20 | 25 | | | 0 | 280 | 6.95 | 394 | 7.03 | Yes |
| | | | | | 40 | 327 | | 455 | | |
| | | | | | 70 | 345 | 6.8 | 483 | 6.88 | |
| | | | | | 80 | | 6.64 | | 6.72 | |
| Melt D | 55 | 12 | | | 0 | 274 | 11.28 | 425 | 13.31 | Yes |
| | | | | | 40 | 333 | | 490 | | |
| | | | | | 70 | 348 | 11.54 | 510 | 13.18 | |
| | | | | | 80 | | 10.2 | | 12.06 | |
| Melt E | 17.4 | 27 | | | 0 | 280 | 5.9 | 421 | 7.1 | Yes |
| | | | | | 40 | 315 | | 507 | | |
| | | | | | 70 | 335 | 6.3 | 520 | 6.3 | |
| | | | | | 80 | | 6.2 | | 6.2 | |
| Melt F | 45 | 15 | 0.3 | 0.25 | 80 | 310 | 7.8 | 455 | 9.3 | No |
| Melt G | 20 | 25 | 0.3 | 0.25 | 80 | 275 | 5.2 | 401 | 5.6 | No |

The properties of these test melts A to E with varying nickel and cobalt contents were used to determine the relationship between these elements, giving the following formula:

$$Ni=-0.3714*Co+32.429\% \text{ by weight}$$

The tolerance was in this case +1.0 and −1.5% by weight, as will be clear from FIG. 1. After age-hardening of the various melts, the following conductivity was established, as a function of the cobalt content, for cobalt contents of more than 45% by weight:

the conductivity was 0.179*Co+2.945 m/Ω $mm^2$ prior to the age-hardening and 0.247*Co+2.041 m/Ω $mm^2$ after age-hardening. The conductivity is virtually constant for alloys whose cobalt content is between 45% by weight and 60% by weight.

Figure 3:
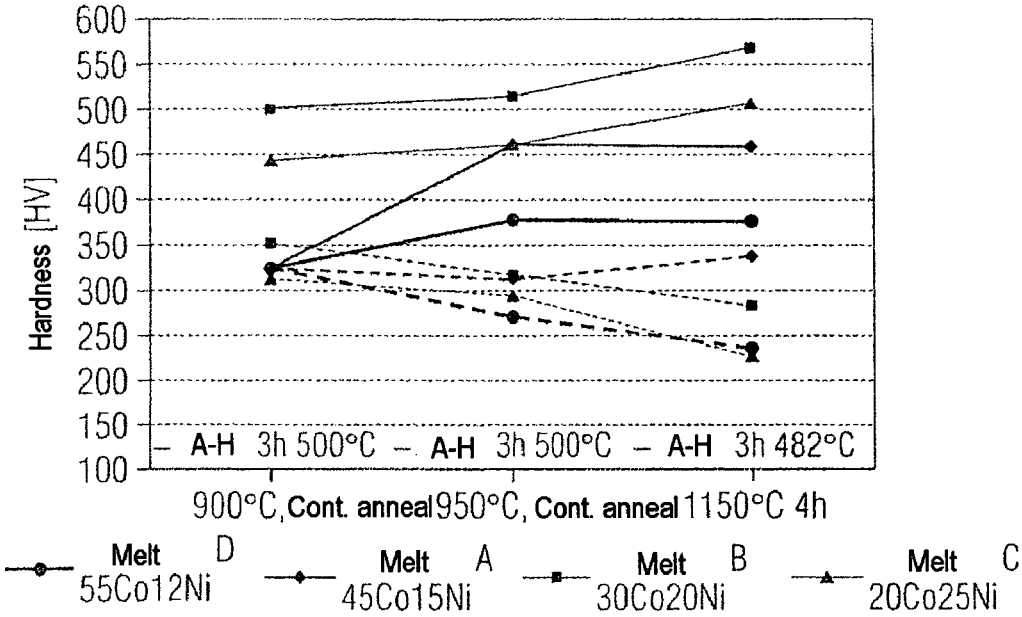
FIG. 3 shows the influence of the homogenization temperature on the hardness before and after age-hardening for the age-hardenable cobalt-nickel-iron alloys.

The influence of the homogenization temperature on the hardness before and after the age-hardening from the soft state is described in FIG. 3. Accordingly, the homogenization temperature can be selected with relative freedom. However, to set a targeted fine-grained austenite and therefore to reduce the "orange peel effect" during bending operations, i.e. with grain sizes of between 10 μm and 30 μm, prior to the age-hardening, a low homogenization temperature of 900 to 950° C. was selected, which is suitable for a continuous anneal. This results in age-hardening times of from 2 to 4 hours at 400 to 550° C., which is favorable from a process engineering perspective.

Figure 4:
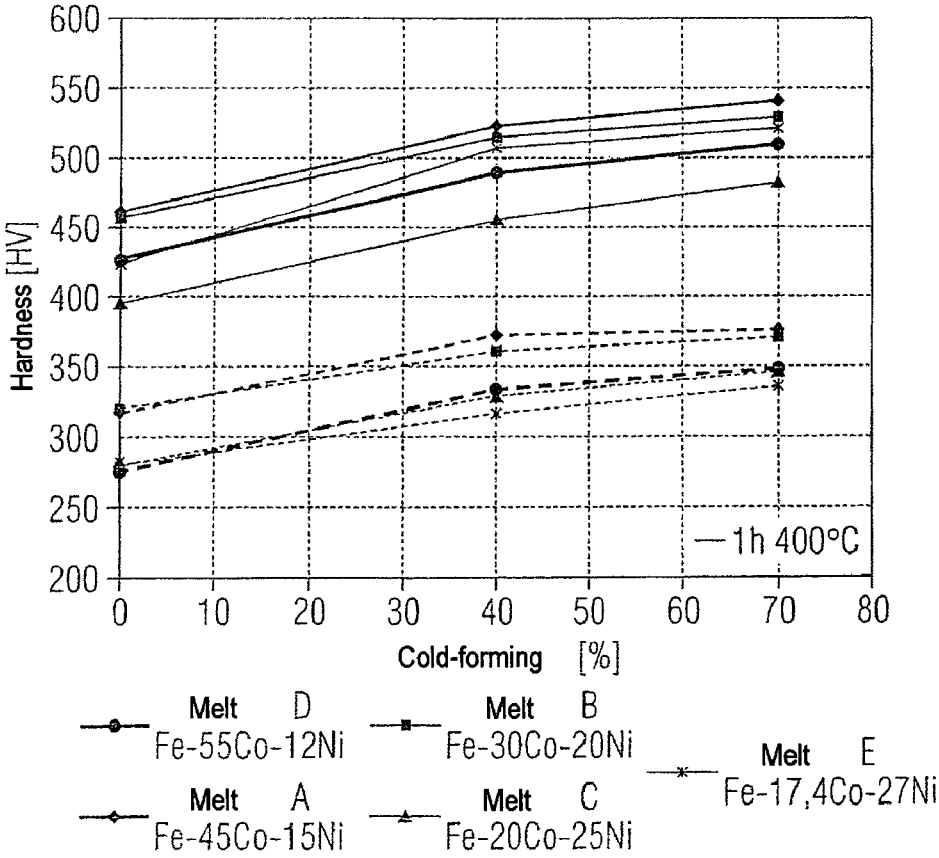
FIG. 4 shows the influence of the cold-forming on the hardness before and after the age-hardening for the age-hardenable cobalt-nickel-iron alloys.
Figure 5:
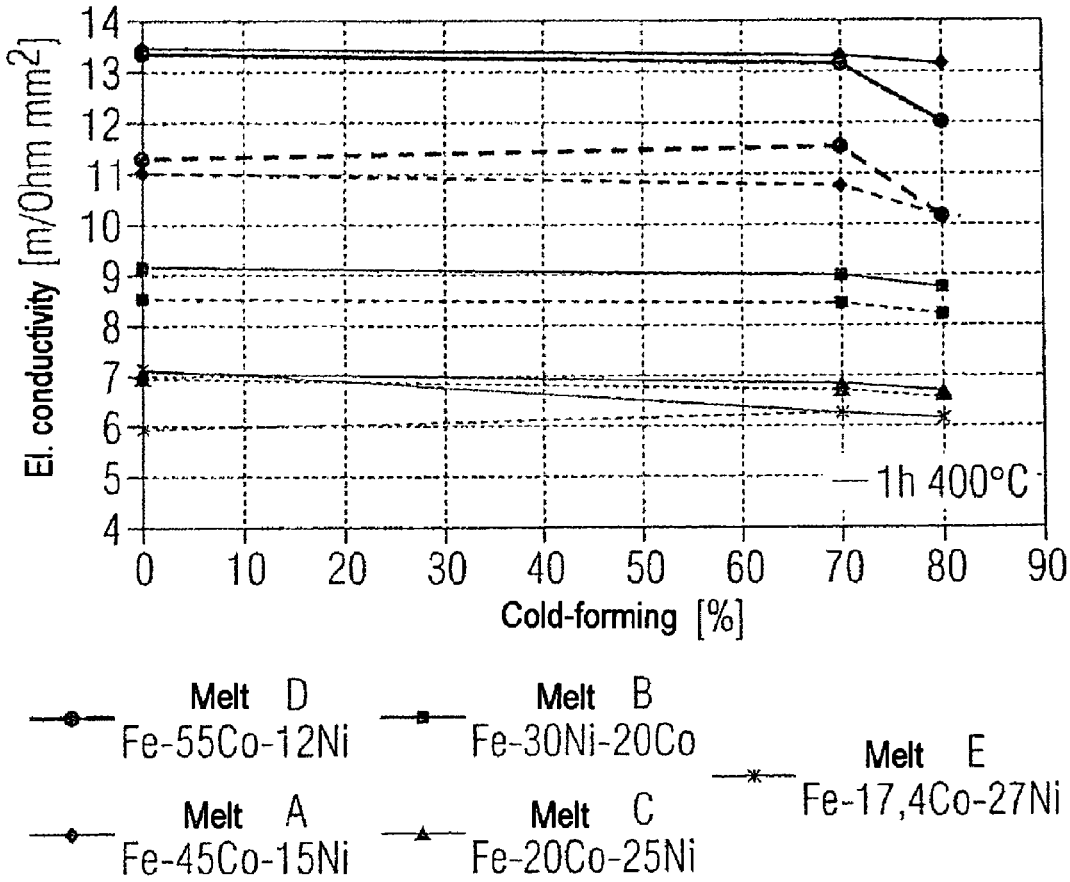
FIG. 5 shows the influence of the cold-forming on the conductivity before and after age-hardening of the age-hardenable cobalt-nickel-iron alloy.

The influence of the cold-forming before and after the age-hardening on the hardness and conductivity is presented in FIGS. 4 and 5. It can be seen from these figures that the age-hardening change is relatively independent of the degree of cold-forming.

Figure 6:
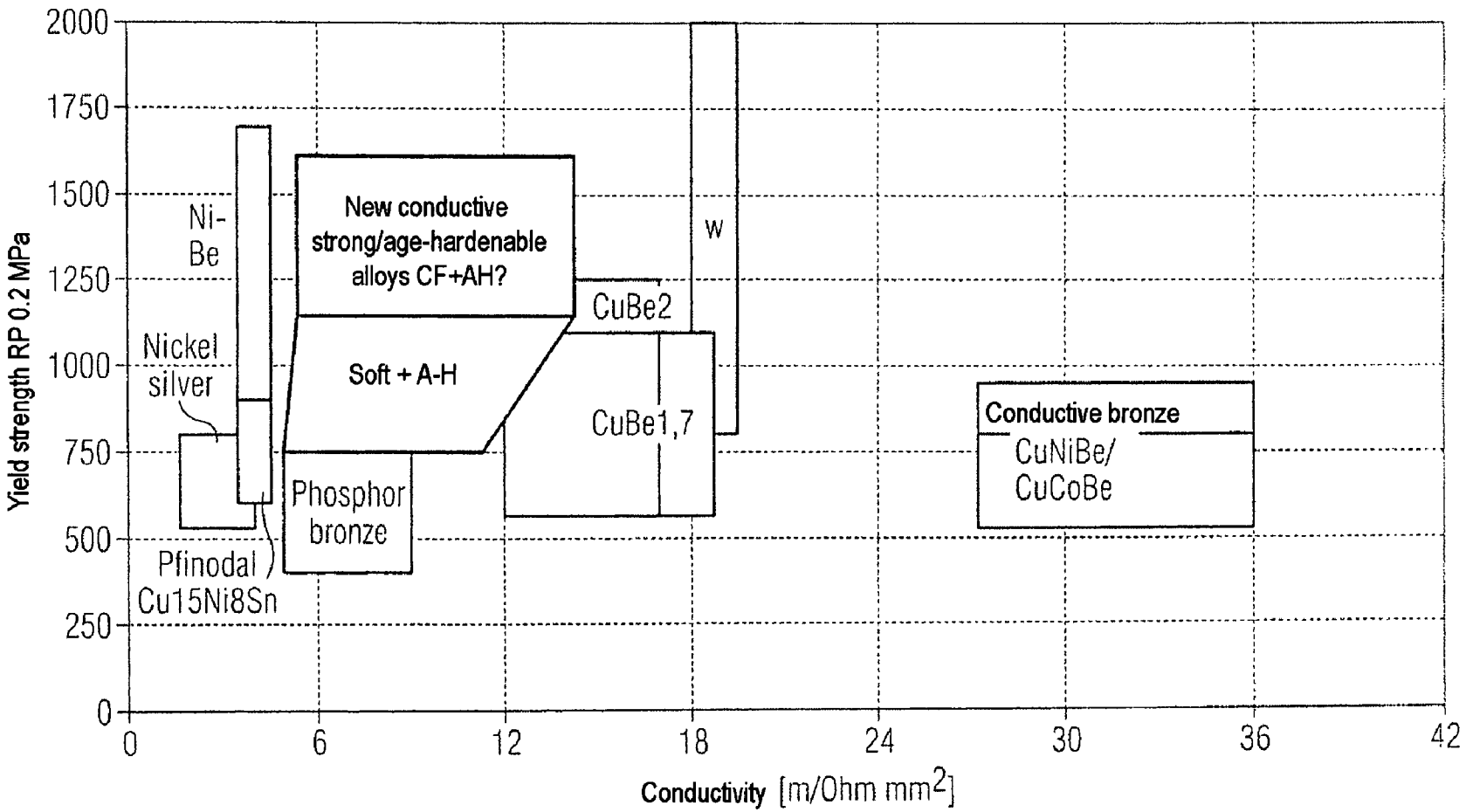
FIG. 6 shows a comparison of various materials from the prior art with regard to yield strength and conductivity for the age-hardenable cobalt-nickel-iron alloys.
Figure 7:
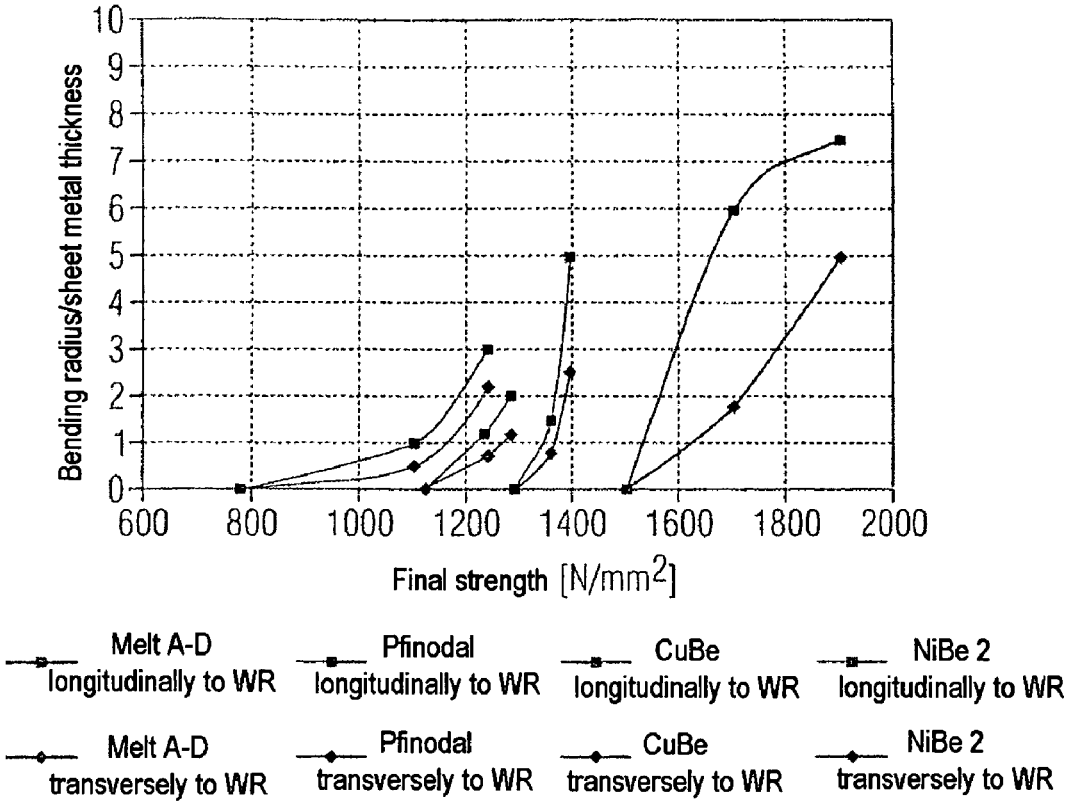
FIG. 7 shows a comparison of the bending radii of various age-hardenable cobalt-nickel-iron alloys in accordance with the present invention with alloys from the prior art as a function of the final strength.

FIGS. 6 and 7 show a comparison with materials of the prior art. According to these figures, higher strengths are achieved for a similar conductivity to beryllium bronzes. The bendability is very good in the soft state prior to age-hardening. In the figures, "WR" denotes the rolling direction and "WV" denotes in-factory heat treated.

It was possible to demonstrate by relaxation tests that the heat resistance in the age-hardened state, at 200-250° C., is significantly higher than in the case of CuBe and therefore reaches that of NiBe.

The following physical properties were achieved in Table 2. They apply to the fully martensitic state of the age-hardenable alloy option at cobalt contents of 17.4 and 45.0% by weight. Other values for other cobalt contents are obtained by interpolation or extrapolation for values of <17.4% by weight. The values for Co contents of >45% by weight are comparable to those achieved at 45% by weight:

TABLE 2

| | | |
|---|---|---|
| Co contents (% by weight) | 17.4 | 45 |
| Electrical conductivity (siemens) | 5.5-6 | 11-13 |
| Thermal conductivity (W/mK) | 50 | 100 |
| Modulus of elasticity (GPa) | 160 | 180 |
| Expansion coefficient | 11 | 11 |
| Ferromagnetism | Yes | Yes |
| Density (g/$cm^3$) | 8.2 | 8.1 |

Figure 8:
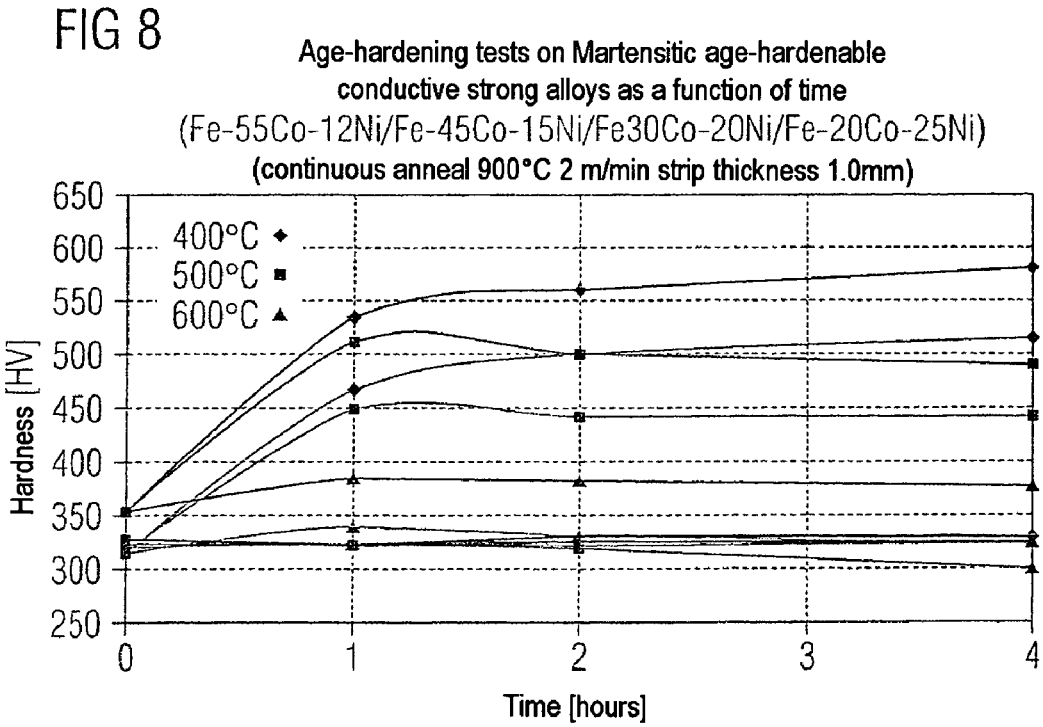
FIG. 8 shows the hardness of various martensitic age-hardenable alloys as a function of the age-hardening time and the age-hardening temperature.

The age-hardenable variants do not represent an alternative to the in-factory heat-treated beryllium bronzes, since they cannot themselves be heat-treated in factory. This is shown in FIG. 8. According to this figure, although the age-hardening maximum shifts toward shorter times at higher temperatures, which is a necessary precondition for continuous heat-treatment in factory, these maximums soon flatten out to such an extent that no further significant age-hardening change is achieved. Moreover, the bending ductility after age-hardening is insufficient.

Therefore, the following text discusses what is referred to as the naturally hard variant, i.e. the cold-formed martensitic cobalt-nickel-iron alloys which have a cobalt content of 12.0≦Co≦60.0% by weight, a nickel content of 10.0≦Ni≦36.0% by weight, remainder iron, and a martensite temperature (Ms) of −50° C.≦Ms≦25° C.

In the cast and hot-rolled state, these naturally hard alloys have a microstructure comprising unstable austenite, i.e. are accordingly relatively soft and become martensitic through subsequent cold-forming. The Vickers hardnesses which can thereby be achieved are approx. 330 HV. It is possible to achieve electrical conductivities of from 5 to 11 m/Ω $mm^2$, depending on the Co content used. It is known from the technology of stainless steels that in addition to the martensites, there may be similar compositions with unstable austenite which can be work-hardened to a very considerable extent by cold-forming. In this case, what is known as deformation martensite is formed. This is also possible in the system of the cobalt-nickel-iron alloys and leads to high strengths. The particular feature of these alloys is the fact that the bending ductility nevertheless remains high.

Table 3 lists various compositions, hardness and conductivities of naturally hard melts which are intended to illustrate the present invention.

TABLE 3

| | Composition (% by weight) remainder Fe | | | | Cold-forming | Without age-hardening | | |
|---|---|---|---|---|---|---|---|---|
| Melt | Co | Ni | Mn | Si | (%) | Hardness (HV) | Electrical conductivity (M/Ωmm²) | Part of the invention |
| A | 17.4 | 27 | | | 0 | 283 | 5.9 | No |
| | | | | | 33 | 303 | 6.4 | |
| | | | | | 60 | 320 | 6.4 | |
| | | | | | 80 | 340 | 6.2 | |
| B | 17.4 | 27.5 | | | 0 | 254 | 4.5 | No |
| | | | | | 33 | 290 | 6 | |
| | | | | | 60 | 305 | 6.3 | |
| | | | | | 80 | 323 | 6.4 | |
| C | 17.4 | 28 | | | 0 | 180 | 2.7 | Yes |
| | | | | | 33 | 250 | 4.5 | |
| | | | | | 60 | 275 | 5.9 | |
| | | | | | 80 | 305 | 6.2 | |
| D | 17.4 | 28.5 | | | 0 | 170 | 2.4 | Yes |
| | | | | | 33 | 226 | 3.3 | |
| | | | | | 60 | 260 | 4.8 | |
| | | | | | 80 | 292 | 5.7 | |
| E | 17.4 | 29 | | | 0 | 160 | 2.4 | No |
| | | | | | 33 | 210 | 2.7 | |
| | | | | | 60 | 230 | 3.5 | |
| | | | | | 80 | 260 | 4.3 | |
| F | 45 | 18 | | | 0 | 178 | 5.6 | Yes |
| | | | | | 33 | 240 | 6.9 | |
| | | | | | 60 | 286 | 9.5 | |
| | | | | | 80 | 328 | 10 | |

It is clear from the above that the hardnesses of copper beryllium materials can be reached at very high levels of cold-forming. This is simultaneously also demonstrated by FIG. 9. At these high levels of cold-forming, the material is fully martensitic and therefore has a better electrical conductivity, as is clear from FIG. 10.

The much lower bending radii parallel to the rolling direction, with a very weak dependency on the cold-forming, as can be seen from FIG. 11, compared to the martensitic alloy compositions and to the copper-beryllium materials and to the material Pfinodal (Cu15Ni8Sn), are amazing. Furthermore, the isotropy of the bending radii is noticeable.

It has been found that accurate setting of the microstructure is very important. First of all, a fine uniform austenitic microstructure is set, in order to obtain a good starting basis for the mechanical work-hardening. With a martensite starting temperature Ms which is at or slightly above room temperature, there are proportions of non-thermally formed martensite. Accordingly, the bending radii are anisotropic and very high with relatively high levels of cold-forming, in the same way as for the martensitic variants. On the other hand, if the martensite temperature is too low, too little deformation martensite is formed and the work-hardening is too low.

Figure 9:
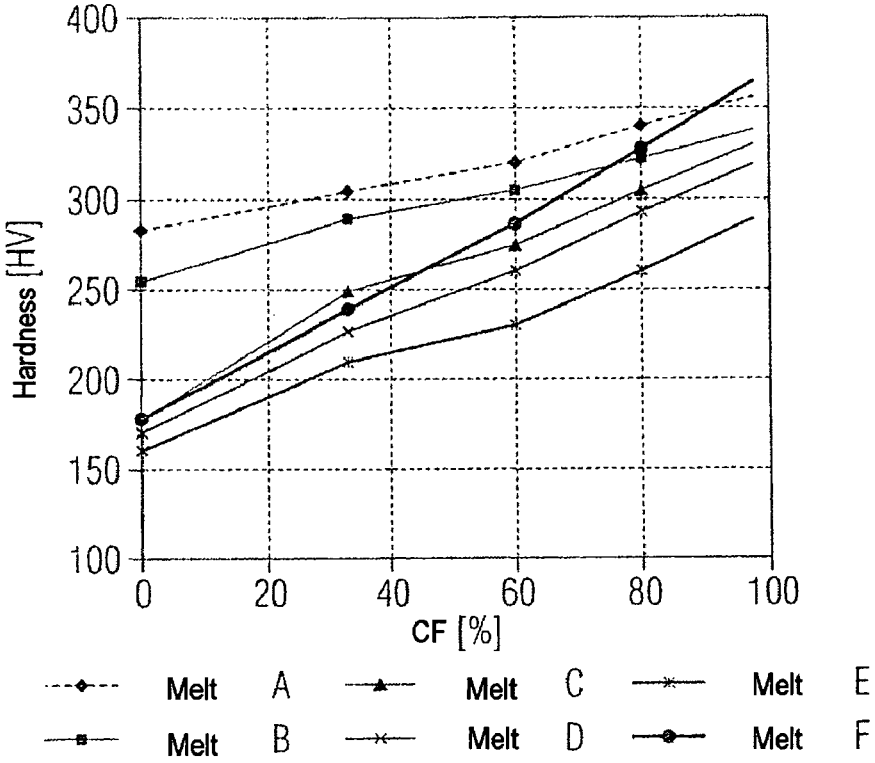
FIG. 9 shows the hardness as a function of the cold-forming of various naturally hard alloys of the present invention by comparison with other alloys.
Figure 10:
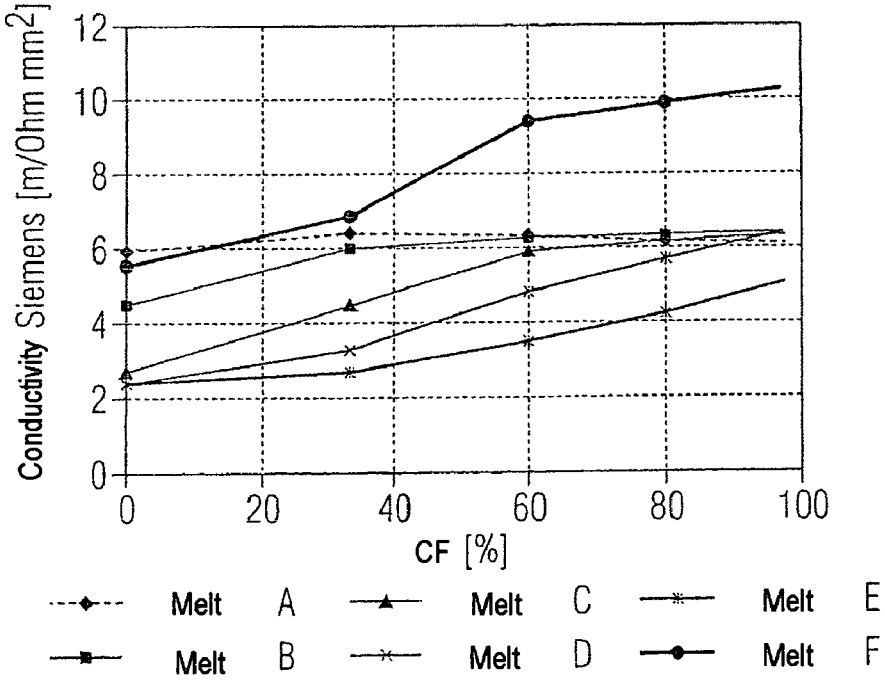
FIG. 10 shows the electrical conductivity of various naturally hard alloys in accordance with the present invention and of other alloys as a function of the degree of cold-forming.
Figure 12:
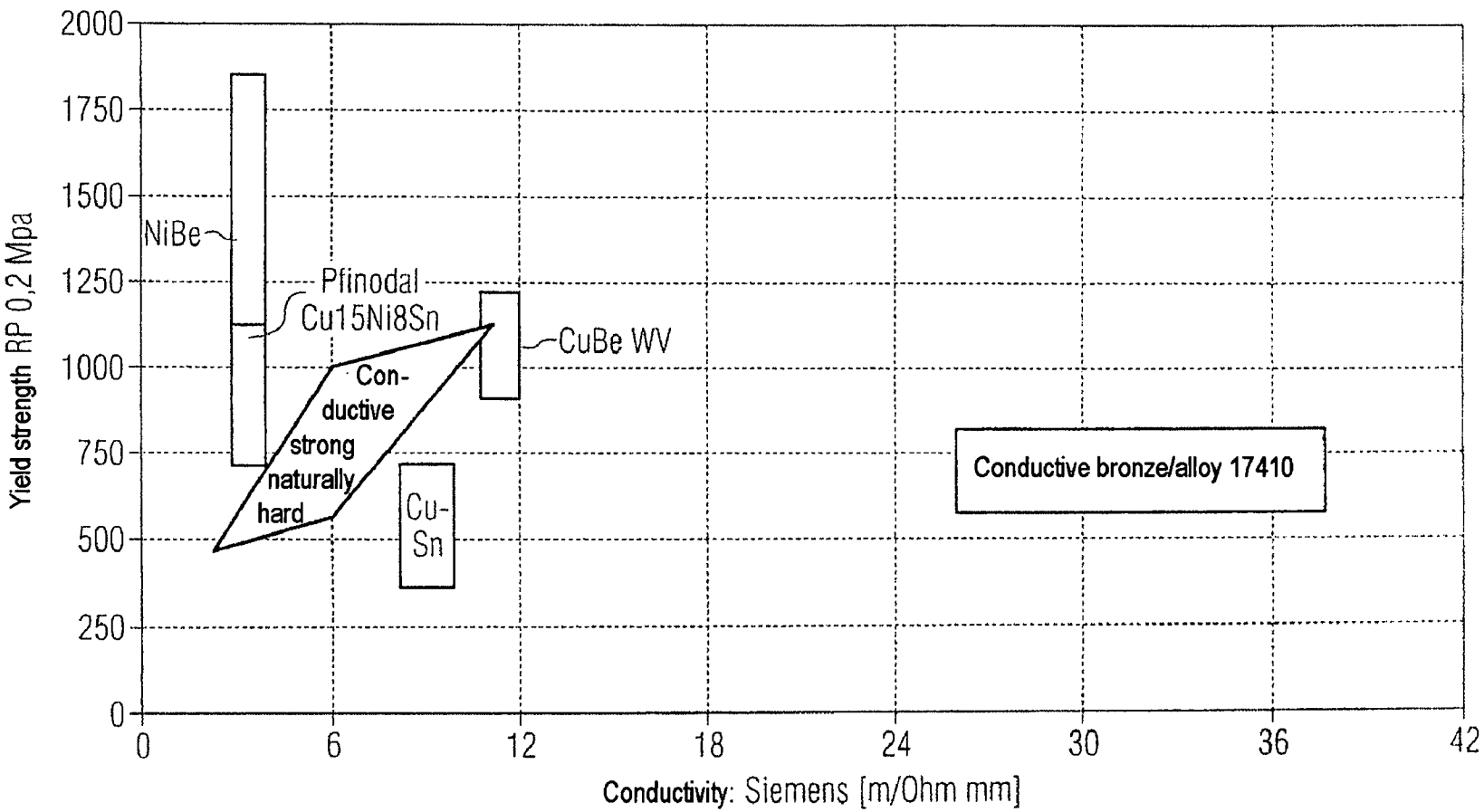
FIG. 12 shows a comparison of various naturally hard or in-factory heat-treated materials from the prior art with the materials according to the invention with regard to yield strength and electrical conductivity.

This can be seen from FIG. 9, in which a cobalt content of 17.4% by weight and a nickel content varying from 27 to 29% by weight was used. For nickel contents of more than 28.6% by weight, the martensite temperature Ms of the alloy is well below room temperature. Then, the austenite is still too stable and the work-hardening too low, which means that only a small amount of deformation martensite is formed even at high levels of cold-forming. Therefore, high hardnesses were not achieved with high levels of cold forming.

At a nickel content of less than 28% by weight, the alloy is partially or completely martensitic in the soft state. Too much non-thermal martensite is formed. Accordingly, the work-hardening is low and the bending radii at sheet metal thicknesses are much lower than those of the unstable austenites with a nickel content of 28-28.5% by weight. Therefore, in the case of the naturally hard alloys of the present invention, the nickel content has to be particularly well matched to the respective cobalt content determining the conductivity, which is achieved by the following formula:

$$Ni=-0.3696*Co+34.65\% \text{ by weight.}$$

The tolerance is in this case approximately +/−0.5% by weight. This gives, a rough value for the conductivity as a function of the cobalt content:

$$\sigma=0.179*Co+2.945\ M/\Omega\ mm^2$$

for a cobalt content of 12% by weight≦Co≦45% by weight and $$\sigma \text{ virtually constant}$$

for a cobalt content of 45% by weight<Co≦60% by weight.

The final cold-forming step should take place quickly after the anneal, since it has been found that what is known as isothermal martensite can also form after a certain time. This limits the possible proportion of deformation martensite, leading to lower work-hardening.

Figure 13:
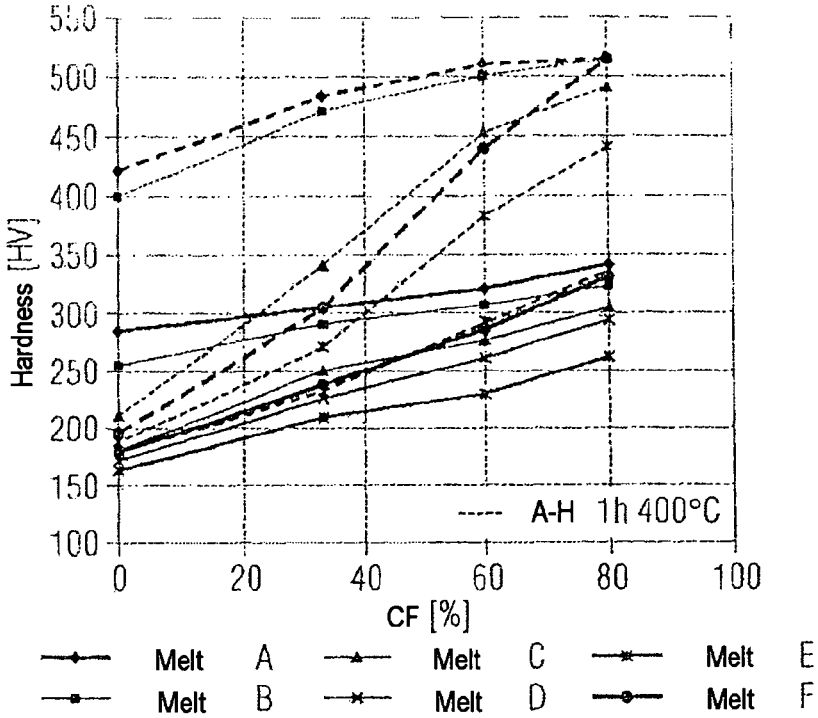
FIG. 13 shows an overview of various naturally hard materials according to the invention and other materials with regard to the hardness before and after age-hardening as a function of the cold-forming.
Figure 14:
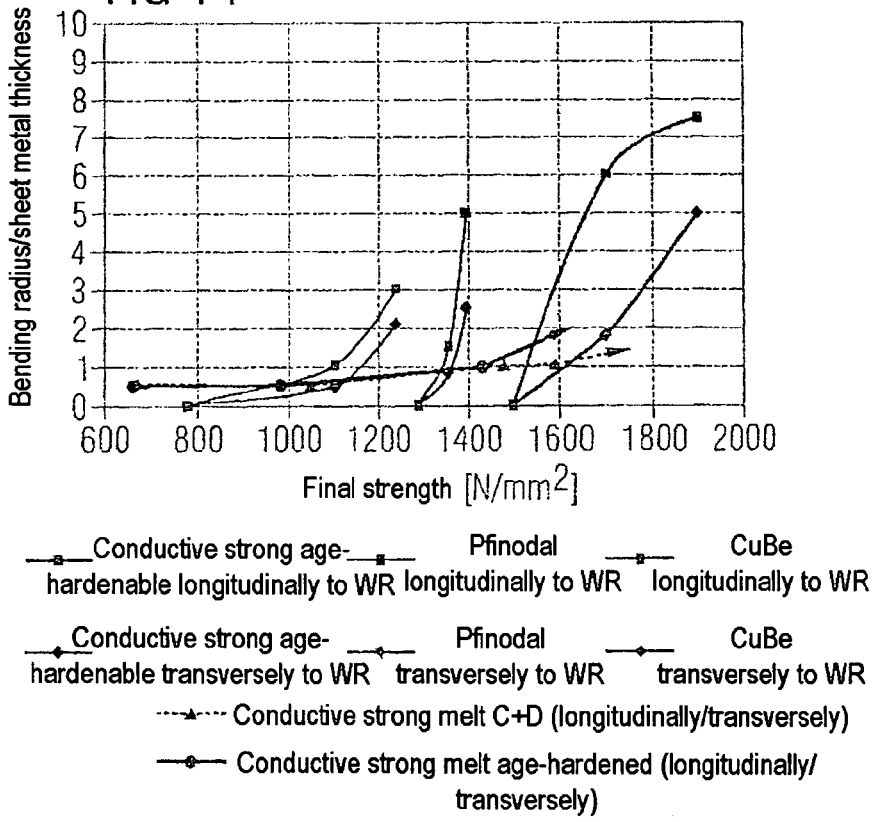
FIG. 14 shows the comparison of the bending radii with respect to final strength between various naturally hard alloys from the present invention after age-hardening by comparison with age-hardenable alloys from the prior art.

Of course, the naturally hard cobalt-nickel-iron alloy option can be age-hardened further. The age-hardening changes are shown in FIG. 13. The age-hardening changes are highly dependent on the cold-forming, since the age-hardening by ordering or microstructure breakdown to form austenite and ferrite presupposes the formation of deformation martensite. The resulting bending radii/final strengths are also illustrated in FIG. 14.

For the naturally hard alloy options, in particular the melts C, D and F from Table 1, the heat resistance is up to 100° C., i.e. the same as for the binary copper beryllium bonzes under comparable loads. The heat resistance can be increased by a heat treatment in a stationary position or continuously at 200 to 300° C. in the form of a prior artificial ageing—but also with Au, Ni coating—without a significant increase in the strength up to 200° C. The heat resistance can be increased up to 250° C. by age-hardening at >300° C.

Table 4 lists the physical properties of two highly cold-formed (degree of cold-forming >70%) naturally hard alloys, firstly an alloy with a cobalt content of 17.4% by weight and secondly an alloy with a cobalt content of 45% by weight. The physical properties of other alloys with different cobalt contents are obtained accordingly by interpolation or extrapolation for Co contents of <17.4% by weight; alloys with Co contents >45% by weight are comparable to those containing 45% by weight.

TABLE 4

| | | |
|---|---|---|
| Co contents (% by weight) | 17.4 | 45 |
| Electrical conductivity (siemens) | 5.5 | 11 |
| Thermal conductivity (W/mK) | 50 | 100 |
| Modulus of elasticity (GPa) | 160 | 180 |
| Expansion coefficient | 11 | 11 |
| Ferromagnetism | Yes | Yes |
| Density (g/cm$^3$) | 8.2 | 8.1 |

In addition to the link between cobalt content and nickel content, attention must also be paid to the impurity content of the melt both for the naturally hard and the age-hardenable martensitic variant. Particular attention needs to be paid in particular for the high-conductivity cobalt-rich variants.

Accordingly, it is opted to produce the alloys according to the invention either by melt metallurgy by melting in vacuo or by powder metallurgy using high-purity starting materials. In the case of the melt-metallurgy process, the starting point is pure raw materials with thorough deoxidization. Furthermore, the melt is desulphurized and decarburized. In the subsequent ladle metallurgy, the impurity level in the raw materials has to be lowered by suitable slag management. With impurity contents of less than 0.05 atomic percent, reductions in conductivity by approx. <3% compared to the ideal value for given cobalt contents are to be expected.

1st EXEMPLARY EMBODIMENT

A naturally hard alloy containing 45% by weight of cobalt, 18% by weight of nickel, remainder iron was cast to form a bar. The raw materials used were electrolytic iron, cobalt rounds from INCO and nickel pellets from INCO. The starting materials were melted in a vacuum induction melting furnace, and deoxidizing and other additions were added according to the expected oxygen and sulphur levels; then, deoxidizing, desulphurizing and decarburizing reactions were carried out, with the assistance of magnetic agitation and argon purging. The slag was settled, with the level of impurities and additions in the melt being monitored. The melt was cast through filter/retention crucibles.

Then, the bar was hot-rolled to a thickness of 3.5 mm at a temperature of 1150° C., ending at approx. 900° C. The strip was quenched to approx. 500° C. by a water shower at the tail-end, in order to stop the static recrystallization. This set an austenite grain size of approximately 10 to 30 μm. Then, the hot-rolled strip was continuously annealed at 900-950° C. followed by rapid quenching and cold-rolling to a thickness of 0.15 mm. The cold-rolling operation was interrupted at a thickness of 1.5 mm, and during this interruption the strip was ground, trimmed and subjected to a continuous intermediate anneal at a temperature of between 900° C. and 950° C. with subsequent rapid cooling. After the continuous annealing, rolling was continued quickly over the course of 1-2 days. The cold-forming amounted to 90%.

The result was a strip which had a bending radius of 1 to 2 times the thickness and a Vickers hardness of 350 HV, as well as an electrical conductivity a of 10.0 m/Ω $mm^2$.

2nd EXEMPLARY EMBODIMENT

A naturally hard alloy containing 17.4% by weight of cobalt, 28.2% by weight of nickel, remainder iron was produced in wire form by powder metallurgy. The raw materials used were cobalt carbonyl powder, iron carbonyl powder and nickel carbonyl powder. The powders were mixed and compacted to form a billet. Then, the billet was sintered in hydrogen with a stage anneal to produce a high density of >95%. The fully sintered billet was hot-rolled to a thickness of 6 mm at a temperature of approx. 1100° C., ending at approx. 900° C., and was then quenched to approx. 300° C. by a water shower at the tail-end, in order to stop the static recrystallization. An austenite grain size of 10 to 30 μm was established.

Then, the wire was quickly drawn to a diameter of 0.6 mm within 1-2 days, which corresponded to cold-forming of 99% without intermediate anneals. The drawing was interrupted by grinding or shaving. The properties of the finished wire were a very good bending radius about itself, a Vickers hardness of 340 HV and an electrical conductivity a of 6.0 m/Ω$mm^2$.

3rd EXEMPLARY EMBODIMENT

An age-hardenable alloy containing 45% by weight of cobalt, 15% by weight of nickel, remainder iron, was produced as a strip by melt metallurgy.

The starting materials used in this case were electrolytic iron, cobalt rounds from INCO and nickel pellets from INCO. The starting materials were melted in a vacuum induction melting furnace. Deoxidization additions were added according to the oxygen level present. Then, deoxidizing and decarburizing and/or desulphurizing reactions were left to proceed and assisted by magnetic agitation and argon purging. The level of impurities and the deoxidization additions were monitored in the melt. The metal was then cast.

The bar formed was hot-rolled to 3.5 mm at 1150° C. finishing at approx. 900° C. The hot-rolled strip was then quenched to approx. 200° C. by a water shower in the tail-end in order to stop the static recrystallization. An austenite grain size of 10 to 30 μm was established.

Then, the hot-rolled strip was cold-rolled to 0.15 mm. The cold-rolling was interrupted at a thickness of 1.5 mm. During this interruption, the strip was ground and trimmed and subjected to a continuous intermediate anneal at a temperature of from 900 to 950° C. with subsequent rapid cooling. This was followed by a final continuous anneal at a temperature of approx. 900 to 950° C. with rapid cooling. The properties of the strip prior to age-hardening were a bending radius of less than half the thickness; after the age-hardening, a Vickers hardness of 450 HV and an electrical conductivity σ of 13.3 m/Ω $mm^2$ were achieved.

4th EXEMPLARY EMBODIMENT

An age-hardenable alloy containing 20% by weight of cobalt, 25% by weight of nickel, remainder iron was produced as a wire by powder metallurgy. The starting materials used were cobalt carbonyl powder, nickel carbonyl powder and iron carbonyl powder. The powders were mixed and then compacted to form a billet. The billet was sintered in a hydrogen atmosphere with a stage anneal to produce a high density of >95%. The billet formed was hot-rolled to a thickness of 6 mm at 1100° C. ending at approx. 900° C. It was then quenched to 300° C. using the water shower in the tail-end in order to stop a static recrystallization. The grain size was deliberately set to 10 to 30 μm. Then, the wire was drawn to a diameter of 0.6 mm, interrupted by grinding or shaving. Then, the wire which had been drawn to a diameter of 0.6 mm was subjected to a continuous anneal at 900° C. to 950° C. with rapid cooling and finally drawn again, to a diameter of 0.3 mm.

The properties achieved were a bending radius about itself and, after age-hardening, a Vickers hardness of 480 HV and an electrical conductivity a of 6.8 m/Ω $mm^2$.

What is claimed is:

1. A material for electrical contacts consisting of a cold-formed martensitic cobalt-nickel-iron alloy with a high strength, a high bendability and a high electrical conductivity, consisting of a cobalt content of 45.0≦Co≦60.0% by weight, a nickel content of 10.0≦Ni≦36.0% by weight, remainder iron and an impurity content of less than 0.2 atomic percent, with a martensite temperature Ms of −50° C. ≦Ms≦25° C.

2. The material for electrical contacts according to claim 1, with an impurity content of less than 0.1 atomic percent.

3. The material for electrical according to claim 2, with an impurity content of less than 0.05 atomic percent.

4. The material for electrical contacts according to claim 1, wherein the material is configured in a contact spring or a thermal switch.

5. The material for electrical contacts according to claim 1, wherein the material is configured in a test tip comprising wire or rods for semiconductor components, a circuit hoard, or a cable harness.

6. The material for electrical contacts according to claim 1, wherein the material is configured in a brush comprising wire for resistance transducers with sliding contact.

7. The material for electrical contacts according to claim 1, wherein the material is configured in a spot-weld of wire electrodes.

8. The material for electrical contacts according to claim 1, wherein the material is configured in casting wheels for the rapid solidification of amorphous or nanocrystalline materials.

9. The material for electrical contacts according to claim 1, wherein the material is configured in a light metal casting tool or an injection molds.

* * * * *

UNITED STATES PATENT AND TRADEMARK OFFICE

CERTIFICATE OF CORRECTION

PATENT NO. : 7,578,893 B2
APPLICATION NO. : 11/206885
DATED : August 25, 2009
INVENTOR(S) : Hartwin Weber et al.

It is certified that error appears in the above-identified patent and that said Letters Patent is hereby corrected as shown below:

Title page, [54] Please correct the title to read ELECTRICAL CONTACT MATERIAL COMPRISING A COBALT-NICKEL-IRON ALLOY, AND PROCESS FOR PRODUCING SAID ALLOY Title page, [30] Please insert the Foreign Application Priority Data as follows:

-- February 20, 2003 DE 103 07 314.0 --

Signed and Sealed this

Twenty-fourth Day of November, 2009

David J. Kappos

David J. Kappos
*Director of the United States Patent and Trademark Office*

UNITED STATES PATENT AND TRADEMARK OFFICE

CERTIFICATE OF CORRECTION

PATENT NO. : 7,578,893 B2
APPLICATION NO. : 11/206885
DATED : August 25, 2009
INVENTOR(S) : Hartwin Weber et al.

It is certified that error appears in the above-identified patent and that said Letters Patent is hereby corrected as shown below:

Title page, [54] and Column 1, lines 1-3, Please correct the title to read ELECTRICAL CONTACT MATERIAL COMPRISING A COBALT-NICKEL-IRON ALLOY, AND PROCESS FOR PRODUCING SAID ALLOY Title page, [30] Please insert the Foreign Application Priority Data as follows:

-- February 20, 2003 DE 103 07 314.0 --

This certificate supersedes the Certificate of Correction issued November 24, 2009.

Signed and Sealed this

Fifteenth Day of December, 2009

David J. Kappos

David J. Kappos
*Director of the United States Patent and Trademark Office*